United States Patent [19]

Carey, Jr.

[11] Patent Number: 4,631,933

[45] Date of Patent: Dec. 30, 1986

[54] STITCH-BONDED THERMAL INSULATING FABRICS

[75] Inventor: Patrick H. Carey, Jr., Bloomington, Minn.

[73] Assignee: Minnesota Mining and Manufacturing Company, Saint Paul, Minn.

[21] Appl. No.: 660,282

[22] Filed: Oct. 12, 1984

[51] Int. Cl.[4] ..... D04B 23/10

[52] U.S. Cl. ..... 66/192; 66/8 A; 66/190

[58] Field of Search ..... 66/85 A, 190, 192, 84 A, 66/194; 428/903

[56] References Cited

U.S. PATENT DOCUMENTS

| | | | |
|---|---|---|---|
| Re. 28,118 | 2/1976 | Ehrlich | 66/192 |
| 2,890,579 | 6/1959 | Mauersberge | 66/192 |
| 3,279,221 | 10/1966 | Gliksmann | 66/192 |
| 3,329,552 | 7/1967 | Hughes | 66/192 |
| 3,597,941 | 8/1971 | Jindra | 66/194 |
| 3,616,124 | 10/1971 | Danhel | 66/192 |
| 3,635,786 | 1/1972 | Hughes | 66/192 |
| 3,649,428 | 3/1972 | Hughes | 66/192 |
| 3,664,157 | 5/1972 | Kochta et al. | 66/190 |
| 3,782,137 | 1/1974 | Hughes | 66/192 |
| 3,910,072 | 10/1975 | Svoboda et al. | 66/85 |
| 3,967,472 | 7/1976 | Wildeman | 66/85 A |
| 3,991,593 | 11/1976 | Bernert | 66/85 A |
| 3,992,904 | 11/1976 | Webb et al. | 66/190 |
| 4,118,531 | 10/1978 | Hauser | 66/85 |
| 4,158,292 | 6/1979 | Ehedy et al. | 66/192 |
| 4,197,723 | 4/1980 | Ehedy et al. | 66/192 |

FOREIGN PATENT DOCUMENTS

| | | |
|---|---|---|
| 1427191 | 3/1976 | United Kingdom . |

*Primary Examiner*—Ronald Feldbaum
*Assistant Examiner*—Mary A. Ellis
*Attorney, Agent, or Firm*—D. M. Sell; J. A. Smith; C. Truesdale

[57] ABSTRACT

A thermal insulating fabric is described. The fabric is a stitch-bonded, fibrous, nonwoven web of microfibers that average about 10 micrometers or less in diameter.

9 Claims, 3 Drawing Figures

STITCH-BONDED THERMAL INSULATING FABRICS

BACKGROUND OF THE INVENTION

1. Field of the Invention

The present invention relates ro stitch-bonded thermal insulating fabrics, which are useful in apparel, particularly for innerwear and sleepwear, blankets, bedspreads, etc.

2. Background Information

Fabrics having a base layer stitched-bonded with yarn are well-known in the art. Base layers of loose material, such as matting, an array of loose filling threads, or a layer of wadding, may be stitch-bonded, i.e. bound or enmeshed with the loops of a multitude of chain-stitched warp threads, to provide a fabric having coherence, tensile strength, and durability as disclosed in U.S. Pat. No. 2,890,579 (Mauersberger). Nonwoven fabric webs have been stitch-bonded to provide varied patterned surfaces as disclosed in U.S. Pat. Nos. 3,664,157 (Kochta et al.), 3,782,137 (Hughes), and 3,992,904 (Webb et al.). Stitch-bonding has also been used to secure loop-pile threads to a base layer as disclosed in U.S. Pat. No. 3,597,941 (Jindra et al.). British Patent Application No. 1,427,191 discloses a stitch-bonded fabric having a base layer which contains thermally bondable fibers to increase abrasion resistance and pill resistance.

U.S. Pat. No. 3,910,072 (Svoboda et al.) discloses a stitchbonded fabric with thermoinsulating properties which includes a base layer such as a needled-reinforced fibrous fleece, a woven fabric or knitted fabric, transversely arranged weft threads and stitch-bonding warp threads.

SUMMARY OF THE INVENTION

The present invention relates to a stable, thermal insulating fabric which is a stitch-bonded, fibrous, nonwoven web of microfibers that average about 10 micrometers or less in diameter. The stitch-bonded web preferably has a thermal resistance of at least about 0.035 k.m$^2$/watt, air pemeability of less than 1 m$^3$/sec/m$^2$, tensile strength in the machine direction of at least about 15 kg and tensile strength in the transverse direction of at least about 10 kg.

In a preferred embodiment of the invention, the nonwoven web further contains crimped bulking fibers that have a percent crimp of at least 15 percent intermixed and intertangled with the microfibers with the weight ratio of microfibers to crimped bulking fibers in the range of from about 9:1 to 1:9.

These stitch-bonded fabrics provide excellent thermal insulating properties at low basis weight and may be utilized in a variety of end products including bedspreads, blankets outerwear, linings, etc. and are particularly useful for innerwear, e.g., thermal underwear, and sleepwear.

DETAILED DESCRIPTION OF THE INVENTION

Figure 1:
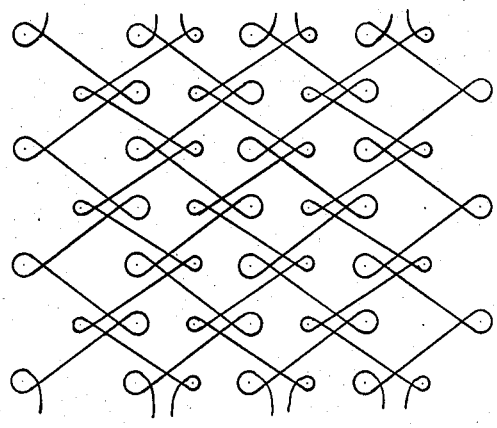
FIG. 1 is a diagrammatic representation of the stitch configuration used in stitch-bonding the fabrics of Examples 1 and 3.

Fibrous nonwoven webs, stitch-bonded according to the present invention typically have a basis weight in the range of 20 to 300 g/m$^2$ and bulk density less than about 0.05 g/cm$^3$. Particularly preferred are webs produced according to the teachings of U.S. Pat. No. 4,118,531 (Hauser) which is incorporated herein by reference. These webs include microfibers, generally averaging less than about 10 micrometers in diameter, and bulking fibers, i.e., crimped, generally larger-diameter fibers, which are randomly and thoroughly intermixed and intertangled with the microfibers and account for at least 10 weight percent of the fibers in the web. The crimped bulking fibers function as separators within the web, separating the microfibers to produce a lofty resilient web. Such a web possesses excellent thermal insulating properties.

The web may consist of a single layer, or may be a multi-layer product in which the layers are typically indistinguishable to at least casual inspection. Preferred webs are soft and pliable, so that the resulting fabric is soft and pliable.

The insulating quality of microfibers is generally independent of the material from which they are formed, and microfibers may be formed from nearly any fiber-forming material. Representative polymers for forming melt-blown microfibers include polypropylene, polyethylene, polyehtylene terephthalate, polyamides, and other polymers as known in the art. Useful polymers for forming microfibers from solution include polyvinyl chloride, acrylics and acrylic copolymers, polystyrene, and poysulfone. Inorganic materials also form useful microfibers.

The finer the microfibers in the web the better the thermal resistance. Blown microfibers (prepared by extruding a liquid fiber-forming material through an orifice into a high-velocity gaseous stream) can conveniently be prepared in diameters smaller than ten micrometers. To form useful webs, the aspect ratio (ratio of length to diameter) of the microfibers should approach infinity, though blown microfibers are usually thought to be discontinuous.

The optional crimped bulking fibers, i.e., having a continuous wavy, curly, or jagged character along their length, are available in several different forms for use as the bulking fibers in the web. Three-dimensionally crimped fibers generally encourage greater loftiness in the web. However, good webs can be produced from fibers having any of the known types of crimp.

The number of crimps per unit of length can vary rather widely in the bulking fibers. In general, the greater the number of crimps per centimeter, the greater the loft of the web. However, larger-diameter fibers will produce an equally lofty web with fewer crimps per unit of length than a smaller-diameter fiber.

Crimped bulking fibers also vary in the amplitude or depth of their crimp. Although amplitude of crimp is difficult to uniformly characterize in numerical values because of the random nature of many fibers, an indication of amplitude is given by percent crimp. The latter quantity is defined as the difference between the uncrimped length of the fiber (measured after fully straightening a sample fiber) and the crimped length (measured by suspending the sample fiber with a weight attached to one end equal to 2 miligrams per decitex of the fiber, which straightens the large-radius bends of the fiber) divided by the crimped length and multiplied by 100. Bulking fibers used in the present invention generally exhibit an average percent crimp of at least about 15 percent, and preferably at least about 25 percent.

The crimped bulking fibers should, as a minimum, have an average length sufficient to include at least one complete crimp and preferably at least three or four crimps. The bulking fibers should average between about 2 and 15 centimeters in length. Preferably the bulking fibers are less than about 7–10 centimeters in length.

Synthetic crimped bulking fibers are preferred and may be made from many different materials but naturally occurring fibers may also be used. Polyester crimped staple fibers are readily available and provide useful properties. Other useful fibers include acrylics, polyolefins, polyamides, rayons, acetates, etc. Webs of the invention may include more than one variety of bulking fiber, as well as more than one variety of microfiber.

The finer the staple fibers, the greater the insulating efficiency of a composite web, but the web will generally be more easily compressed when the staple fibers are of a low denier. Most often, the bulking fibers will have sizes of at least 3 decitex and preferably at least 6 decitex, which correspond approximately to diameters of about 15 and 25 micrometers, respectively.

The amount of crimped bulking fibers included or blended with microfibers will depend upon the particular use to be made of the fabric of the invention. Generally at least 10 weight-percent of the blend will be bulking fibers to provide the desired low weight for a given amount of thermal resistance, and preferably at least 25 weight-percent of the blend will be bulking fibers. On the other hand, to achieve good insulating value, especially in the desired low thickness, microfibers will account for at least 25, preferably at least 50 weight-percent of the blend. Stated another way, the weight ratio of microfibers to bulking fibers in webs useful in the invention will generally be between 9:1 and 1:3, and preferably between 3:1 and 1:1.

Fibrous webs for stitch-bonding according to the invention can be supplied in any desired thickness depending again on the particular use to be made of the stitch-bonded fabric, but a convenient thickness is between about 4 and 20 millimeters. The loft or density of the web prior to stitch-bonding can also be varied for particular uses, though generally the webs will have a loft of at least about 30 cubic centimeters/gram, and preferably of at least about 50 cubic centimeters/gram.

Fibrous webs used in the invention may include minor amounts of other ingredients in addition to the microfibers and crimped bulking fibers. For example, fiber finishes may be sprayed onto a web to improve the hand and feel of the web. Additives, such as dyes and fillers, may also be added to webs of the invention by introducing them to the fiber-forming liquid of the microfibers or crimped bulking fibers.

Stitch-bonding of the microfiber or composite web can be carried out on known stitch-bonding equipment. Particularly preferred are the stitch-bonding machines which are equipped with at least two guide bars such as Malimo "Maliwatt" machines or the "Arachne" machines. The two guide bar machines are particularly preferred for their lapping and patterning capabilities, lapping stitches providing increased fabric strength in the transverse direction. Machines having a guage of 3.5 to 28 needles/25 mm are preferred for most end use applications of the fabric of the invention, with 7 needles/25 mm particularly preferred where the fabric of the invention is for use in thermal underwear or sleepwear.

The stitch-bonding stabilizers the fabric sufficiently to permit the fabric to be used without the need for a supporting fabric layer as is required with the unstitch-bonded web. Whereas, prior to stitch-bonding, a fibrous web, especially of blown microfibers, will tear or separate to form voids of poor or no insulating quality under tensile forces such as experienced during garment manufacture or use, the fabric formed by stitch-bonding has increased tensile strength and generally can be repeatedly stretched small amounts without rupture or deformation.

Figure 2:
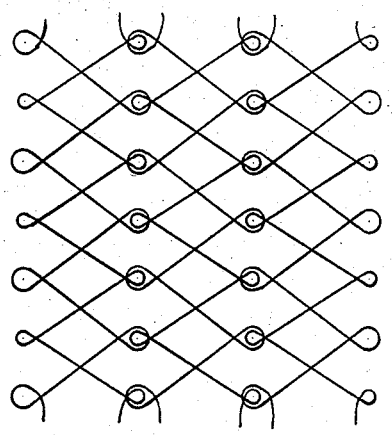
FIG. 2 is a diagrammatic representation of the stitch configuration used in stitch-bonding the fabric of Example 2.
Figure 3:
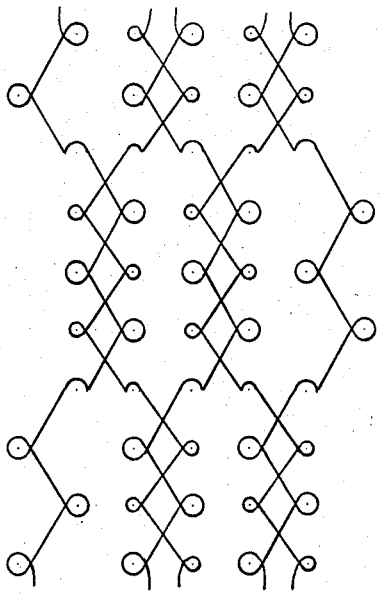
FIG. 3 is a diagrammatic representation of the stitch configuration used in stitch-bonding the fabric of Example 4.

As may be seen from the drawings, the stitch-bonding comprises a repeating pattern of spaced-apart stitching lines extending over the whole area of the web. As shown in FIGS. 1–3, the stitching lines preferably overlap over at least portions of their length. The stitch-bonding tends to subdivide or separate the fibrous web into islands or stripes which are reinforced by the stitching yarns. When tensile force is applied to the web, the force tends to be applied to the stitch-bonding yarns and the localized islands or stripes of fibrous web experience little or no stress.

Preferred stitch-bonding patterns are those which crosslap at least two stitches and which provide a diamond pattern on one face of the fabric. These types of patterns reduce the number of holes caused by the stitching, provide stretch and shape retention, and improve loft. The fabric weight is also affected by the pattern selection as some patterns tend to draw-in, or reduce the width, of the web more than others, with patterns having longer diagonal lapping generally drawing the fabric in more than patterns with less diagonal lapping.

Stitch length may vary depending on the end use application of the fabric and the pattern effects desired. Generally, a stitch length of about 1.0 to 2.5 mm is preferred, with a stitch length of about 1.5 mm particularly preferred for fabric to be used in thermal underwear and sleepwear.

Yarns used for stitch-bonding can be any of the well-known, commercially available spun or continuous filament yarns. Because of their higher strength at comparable denier, continuous filament yarns are generally preferred. Generally, yarn sizes preferred are in the range of about 60 to 300 denier, preferably about 100 to 150 denier. finer denier yarns reduce weight and cost of the fabric but are weaker.

The stitch-bonded fabric of the invention preferably has a thermal resistance of at least about 0.035 $k.m^2/watt$, more preferably at least about 0.045 $k.m^2/watt$ to provide desirable thermal insulating properties. When calculated on the basis weight of the fabric, the thermal resistance is preferably at least about 0.00030 $k.m/watt/g/m^2$, more preferably at least about 0.00035 $k.m^2/watt/g/m^2$.

The stitch-bonded fabric preferably has low air permeability to reduce the infiltration of cold air and the effusion of warm air. Air permeability preferably is less than about 1 $m^3/sec/m^2$ at 124 Pa, more preferably less than about 0.75 $m^3/sec/m^2$ at 124 Pa.

To provide adequate fabric strength for the fabric to be used independently, i.e., without additional protective exterior fabric layers, the fabric generally should have a tensile strength of at least about 15 kg, preferably 20 kg, in the stitch-bonding machine direction and at least about 10 kg, preferably 20 kg, in the transverse direction.

To further increase the strength of the fabric and/or to provide decorative pattern effects, laid in weft yarns may also be included in the fabric.

The invention will be further illustrated by the following examples. In these examples, the fabric properties are evaluated by the following test methods:

Thickness: A 10.2 cm×15.2 cm die cut sample is subjected to a compressive force of 413.6 Pa for 30 seconds, allowed to recover for 30 seconds with the force removed, subjected to a compressive force of 87.1 Pa for 30 seconds, allowed to recover for 30 seconds with the force removed, and then measured for thickness after being subjected to a compressive force of 14.5 Pa for 30 seconds and while under such force.

Tensile Strength: A test sample 10 cm wide and 7.5 cm long (in the test direction) is extended to break at a rate of 50 cm/min.

Thermal Resistance: A sample is tested on a guarded hot plate as described in ASTM Test Method D1518-64 with the test sample subjected to a force of 14.5 Pa during testing.

Air Permeability: A sample is tested on a Frazier air Permeability Tester according to ASTM Test Method D-737.

EXAMPLE 1

A composite fibrous web was prepared according to the process described in U.S. Pat. No. 4,118,531 using polypropylene blown microfibers 1 to 5 micrometers in diameter and 6 denier, 3.75 cm long, 2.8 to 4.4 crimp/cm polyester staple fibers. The web contained 65 weight percent blown microfibers and 35 weight percent staple fibers. The web weight was 44 g/m$^2$. This web was then stitch-bonded on a "Maliwatt" stitch-bonding machine with 150 denier/24 filament polyester yarn using the stitch configuration shown in FIG. 1 and the machine parameters set forth in Table 1. The fabric was then evaluated for basis weight, thickness, strength, thermal resistance, and air permeability. The results are shown in Table 2.

EXAMPLES 2–4

In each of these examples, a web was prepared as in Example 1. The webs were stitch-bonded on a "Maliwatt" stitch-bonding machine with 150 denier/24 filament polyester yarn using the stitch configuratons shown in FIGS. 2, 1, and 3 respectively and the machine parameters set forth in Table 1. The fabrics were evaluated as in Example 1. The results are shown in Table 2.

TABLE 1

| | Example | | | |
|---|---|---|---|---|
| | 1 | 2 | 3 | 4 |
| No. of bars | 2 | 2 | 2 | 2 |
| Stitch length (mm) | 1.5 | 2.0 | 2.0 | 2.0 |
| Yarn ends/2.5 cm | | | | |
| Bar 1 | 7 | 7 | 7 | 7 |
| Bar 2 | 7 | 7 | 7 | 7 |
| Offset space | 1 | 0 | 1 | 1 |
| Needle gauge | M* | M | M | M |

*M denotes medium

COMPARATIVE EXAMPLES 1–3

In Comparative Example 1, a web was made as in Example 1. The web was not stitch-bonded. The web was tested in the same manner as the fabric of Example 1. In Comparative Example 2, a commercially available fleecy jersey knit polypropylene fabric used in thermal insulating innerwear was tested in the same manner as the fabric of Example 1. In Comparative Example 3, a conventional cotton/wool blend fabric used in thermal insulating innerwear was tested in the same manner as the fabric of Example 1. The results are shown in Table 2.

TABLE 2

| | Example | | | | Comparative Example | | |
|---|---|---|---|---|---|---|---|
| | 1 | 2 | 3 | 4 | 1 | 2 | 3 |
| Basis weight (g/m$^2$) | 102 | 131 | 109 | 116 | 44 | 235 | 259 |
| Bulk density (g/cm$^3$) | 0.051 | 0.060 | 0.057 | 0.058 | 0.013 | 0.091 | 0.108 |
| Thickness (cm) | 0.20 | 0.22 | 0.19 | 0.20 | 0.35 | 0.26 | 0.24 |
| Tensile strength (kg) | | | | | | | |
| Machine direction | 30.1 | 22.0 | 28.2 | 35.1 | 1.76 | >40 | >40 |
| Transverse direction | 26.3 | 24.7 | 37.0 | 12.3 | 2.20 | >40 | >40 |
| Thermal resistance | | | | | | | |
| k · m$^2$/watt | 0.046 | 0.053 | 0.041 | 0.046 | 0.109 | 0.064 | 0.039 |
| k · m$^2$/watt/cm$^2$ | 0.23 | 0.24 | 0.22 | 0.23 | 0.31 | 0.24 | 0.16 |
| k · m$^2$/watt/g/m$^2$ | 0.00045 | 0.00041 | 0.00037 | 0.00049 | 0.00247 | 0.00027 | 0.00015 |
| Air permeability (m$^3$/sec/m$^2$ at 124 Pa) | 0.63 | 0.36 | 0.65 | 0.71 | 0.61 | 0.71 | 1.107 |

The stitch-bonded fabrics of Examples 1–4 were subjected to ten launderings. The fabrics were then evaluated for basis weight, thickness and thermal resistance. The results are shown in Table 3. The web of Comparative Example 1 disintegrated after one laundering.

TABLE 3

| | Example | | | |
|---|---|---|---|---|
| | 1 | 2 | 3 | 4 |
| Basis weight (g/m$^2$) | 114 | 129 | 127 | 102 |
| Thickness (cm) | 0.36 | 0.37 | 0.36 | 0.35 |
| Thermal resistance | | | | |
| (k · m$^2$/watt) | 0.080 | 0.089 | 0.072 | 0.074 |
| (k · m$^2$/watt/cm) | 0.22 | 0.24 | 0.20 | 0.21 |

Various modifications and alterations of this invention will be apparent to those skilled in the art without departing from the scope and spirit of the invention and this invention should not be restricted to that set forth herein for illustrative purposes.

What is claimed is:

1. A stable, thermal insulating fabric comprising a stitch-bonded, fibrous, nonwoven web of microfibers that average less than about 10 micrometers in diameter, said fabric having thermal resistance per basis weight of at least about 0.00030 $k.m^2/watt/g/m^2$ and air permeability of less than about 1 $m^3/sec/m^2$.

2. The fabric of claim 1 wherein said web comprises blown microfibers.

3. The fabric of claim 1 wherein said web further comprises crimped bulking fibers that have a percent crimp of at least 15 percent intermixed and intertangled with said microfibers, with the weight ratio of microfibers to crimped bulking fibers in the range of from about 9:1 to 1:9.

4. The fabric of claim 3 wherein said web comprises blown microfibers.

5. The fabric of claim 1 wherein the thermal resistance is at least about 0.035 $k.m^2/watt$.

6. The fabric of claim 1 wherein the tensile strength is at least about 15 kg in the stitch-bonding machine direction and at least about 10 kg in the transverse direction.

7. The fabric of claim 1 wherein the stitch length of said stitch-bonding is about 1.0 to 2.5 mm.

8. The fabric of claim 1 wherein the stitch gauge of said stitch-bonding is about 3.5 to 28 yarns/25 mm.

9. The fabric of claim 1 wherein said stitch-bonding comprises a repeating pattern of spaced-apart stitching lines extending over the entire area of the web, at least some of said stitching lines overlapping with one another over portions of their length.

* * * * *